US008218990B2

(12) United States Patent
Toyohara et al.

(10) Patent No.: US 8,218,990 B2
(45) Date of Patent: Jul. 10, 2012

(54) IMAGE FORMATION SYSTEM, IMAGE FORMATION METHOD, AND IMAGE QUALITY IMPROVEMENT METHOD TWICE HEATING AND PRESSING A TONER IMAGE ON A RECORDING MATERIAL

(75) Inventors: Yuichiro Toyohara, Fujisawa (JP); Takeshi Menjo, Abiko (JP); Jiro Ishiduka, Moriya (JP); Haruhiko Omata, Abiko (JP); Motohide Shiozawa, Abiko (JP); Tatsuomi Murayama, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 615 days.

(21) Appl. No.: 11/916,774

(22) PCT Filed: Sep. 13, 2006

(86) PCT No.: PCT/JP2006/318556

§ 371 (c)(1),
(2), (4) Date: Aug. 3, 2009

(87) PCT Pub. No.: WO2007/032542

PCT Pub. Date: Mar. 22, 2007

(65) Prior Publication Data

US 2010/0021194 A1 Jan. 28, 2010

(30) Foreign Application Priority Data

Sep. 13, 2005 (JP) ..... 2005-266083

(51) Int. Cl.
*G03G 15/20* (2006.01)

(52) U.S. Cl. ..... 399/67; 399/68; 399/69; 399/341

(58) Field of Classification Search ..... 399/67–69, 399/324, 341
See application file for complete search history.

(56) References Cited

U.S. PATENT DOCUMENTS 5,118,589 A * 6/1992 Aslam et al. ..... 399/324
6,042,985 A 3/2000 Matsuda et al.
(Continued)

FOREIGN PATENT DOCUMENTS

CN 1530760 9/2004
(Continued)

OTHER PUBLICATIONS

Office Action in Chinese Patent Application No. 200680030680.5, dated Jun. 19, 2009, with English translation.
(Continued)

*Primary Examiner* — David Gray
*Assistant Examiner* — Laura Roth
(74) *Attorney, Agent, or Firm* — Fitzpatrick, Cella, Harper & Scinto

(57) ABSTRACT

An image formation system includes an image forming apparatus for forming different color toner images on a recording material having a toner reception layer, a first heater for heating and pressing the toner image on the recording material, and a heater for heating and pressing the toner image on the recording material having been heated and pressed by the first heater. The first heater is operable so as to provide a granularity R of the toner image satisfying $0.5 \leqq R \leqq 4.0$ and a glossiness G of the toner image satisfying $5 \leqq G \leqq 40$, the second heater being operable so as to provide a granularity R of the toner image that is not more than 4.0 and a glossiness G of the toner image that is not less than 60.

15 Claims, 6 Drawing Sheets

U.S. PATENT DOCUMENTS

| | | | | |
|---|---|---|---|---|
| 6,819,902 | B2 * | 11/2004 | Toyohara et al. | |
| 7,057,631 | B2 | 6/2006 | Nakamura et al. | 347/115 |
| 7,113,729 | B2 | 9/2006 | Toyohara | |
| 2003/0180063 | A1 | 9/2003 | Kanesawa et al. | |
| 2004/0057741 | A1 | 3/2004 | Uehara et al. | |
| 2004/0131403 | A1 | 7/2004 | Nakamura et al. | |
| 2005/0031379 | A1 | 2/2005 | Toyohara | |
| 2006/0269330 | A1 | 11/2006 | Toyohara | |
| 2007/0254230 | A1 * | 11/2007 | Morales-Tirado et al. | |

FOREIGN PATENT DOCUMENTS

| | | |
|---|---|---|
| EP | 1 403 724 | 3/2004 |
| EP | 1 503 255 | 2/2005 |
| JP | 2002091048 | 3/2002 |
| JP | 2004-118020 | 4/2004 |
| JP | 2005-077587 | 3/2005 |

OTHER PUBLICATIONS

Office Action of Russian Application No. 2008114363/28 (015800), dated Apr. 11, 2008.

Information technology—Office equipment—Measurement of image quality attributes for hardcopy output—Binary monochrome text and graphic images; ISO/IEC 13660:2001.

Russian Decision on Grant in Application No. 2008114363/28(015800), dated Feb. 15, 2010, with English translation.

* cited by examiner (a)

| GRAININESS | EVALUATION | |
|---|---|---|
| 0~0.5 | ◎ | E |
| ~2.0 | ◎ | E |
| ~4.0 | ○ | G |
| ~6.0 | △ | F |
| ~8.0 | × | N |

(b)

| GROSSINESS | EVALUATION | |
|---|---|---|
| ~40 | × | NG |
| ~50 | △ | F |
| ~60 | ○ | G |
| ~70 | ○ | G |
| ~80 | ◎ | E |
| ~90 | ◎ | E |
| ~100 | ◎ | E |

IMAGE FORMATION SYSTEM, IMAGE FORMATION METHOD, AND IMAGE QUALITY IMPROVEMENT METHOD TWICE HEATING AND PRESSING A TONER IMAGE ON A RECORDING MATERIAL

TECHNICAL FIELD

The present invention relates to an image formation system, an image formation method, and an image quality improvement method, which are capable of forming a multicolor toner image. In particular, the present invention relates to an electrophotographic image formation, an electrophotographic image formation method, and an image quality improvement method, which are capable of forming a high quality image, which matches in quality an image formed with the use of a silver salt photographic method.

BACKGROUND ART

An electrophotographic image forming apparatus has been commercialized not only as an apparatus for forming a monochromatic image, but also, as an apparatus for forming a color image. As the electrophotographic image forming apparatus has come to be used in various fields, the level of image quality required to be produced by an electrophotographic image forming apparatus has increased. More specifically, the level of image quality which matches in graininess and glossiness the level of image quality of an image formed by silver salt photography has come to be demanded. One of the technologies for obtaining a color image of excellent glossiness involves the transferring of a color toner image onto a sheet of a recording medium provided with a transparent resin layer formed of thermoplastic resin, and then fixing the transferred toner image to the recording medium to yield a copy which is flat and smooth across the surface.

More specifically, one of the above described image formation methods is disclosed in Japanese Laid-open Patent Application 2004-118020. According to the image formation method described in this publication, an unfixed toner image borne on a sheet of a recording medium is fixed by a heat roller (first fixing apparatus). Then, the sheet of the recording medium is again subject to heat and pressure by a fixation roller (second fixing apparatus), with a fixation belt placed between the fixation roller and the sheet of the recording medium. Then, the sheet of the recording medium is separated from the fixation belt after the sheet is cooled.

As a result, the toner image is fixed while remaining inlaid in the transparent resin layer of the sheet of the recording medium. During the fixation operation, both the surface of the transparent resin layer of the recording medium and the surface of the toner image solidify while conforming to the surface of the fixation belt. Therefore, the sheet of recording medium becomes flat and smooth across its surface, inclusive of the surface of the toner image, thereby yielding a color image of excellent glossiness.

However, the above-described image formation method suffers from the following problem. That is, when the color toner image is fixed by a heat roller during the aforementioned first stage of fixation, the toner layers (which make up the color toner image) are squashed, and as they are squashed, they tend to spread in a direction parallel to the surface of the sheet of the recording medium. Once the toner layers spread in the above-mentioned direction, the image that is produced thereby is inferior in terms of graininess, even if the toner layers are inlaid into the transparent resin layer of the sheet of the recording medium.

In other words, the graininess of the toner image undesirably decreases during the first stage of fixation, although whether or not the quality of the toner image decreases depends on the conditions under which the toner image is fixed during the first stage of fixation. Therefore, it is impossible to obtain a highly glossy image, which is as high in quality as an image formed with the use of silver salt photography, with the use of the abovementioned method.

DISCLOSURE OF THE INVENTION

The primary object of the present invention is to obtain a highly glossy image of high quality.

These and other objects, features, and advantages of the present invention will become more apparent upon consideration of the following description of the preferred embodiments of the present invention, taken in conjunction with the accompanying drawings.

BEST MODE FOR CARRYING OUT THE INVENTION

Hereinafter, the preferred embodiments of the present invention will be described in detail with reference to the appended drawings. Incidentally, if a given component or the like in one of the drawings is identified by the same reference symbol as a component or the like in another drawing, the two components are the same in structure and function. Therefore, once a given component is described, the components identified by the same referencel symbol as the described one will not be described to avoid the repetition of the same description.

Figure 1:
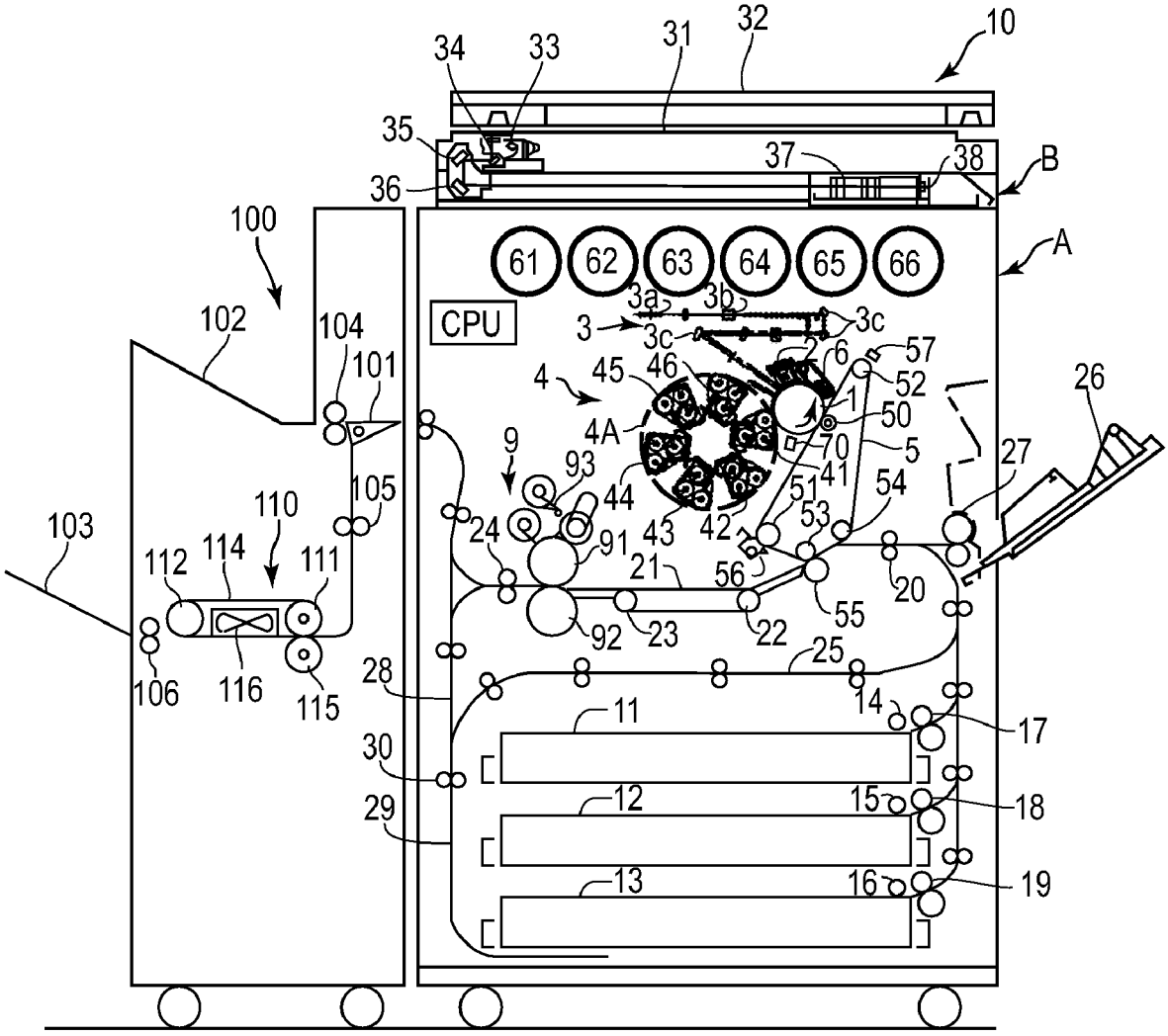
FIG. 1 is a schematic drawing of an example of an image forming apparatus, showing the general structure thereof.

FIG. 1 shows an example of an image forming apparatus. More specifically, FIG. 1 shows an electrophotographic color printer (which hereafter will be referred to as "image forming apparatus"), which has a single image bearing member 1, multiple developing devices 4 (developing devices 41-46), and a rotary unit 4A. The multiple developing devices 4 are mounted in the rotary unit 4A, and the rotary unit 4A is disposed in the adjacencies of the peripheral surface of the image bearing member 1.

First, the general structure of an electrophotographic image forming apparatus will be described with reference to FIG. 1. The image forming apparatus 10 has a digital color image printing portion A (which hereafter will be referred to as the "printer portion") and a digital color image reading portion B (which hereafter will be referred to as the "reader portion"). The reader portion B is above the printer portion A.

In the printer portion A, an electrophotographic photosensitive member 1 (which hereafter will be referred to as the "photosensitive drum"), which is an image bearing member in the form of a drum, is disposed so that it can be rotated in the direction indicated by an arrow mark. In the adjacencies of the peripheral surface of the photosensitive drum 1, a primary charging device 2 as a charging means, a laser-based optical exposing system 3 as an exposing means, a developing apparatus 4 as a developing means, an intermediary transfer belt 5 as an intermediary transfer member, and a cleaning apparatus 6 as a cleaning means, etc., are disposed approximately in the listed order in terms of the rotational direction of the photosensitive drum 1. These members make up an image forming means capable of forming plural toner images which are different in color, on a recording medium.

The abovementioned developing apparatus 4 has a rotary unit 4A, which is a rotatable member, and multiple developing devices mounted in the rotary unit 4A. In the case of this embodiment, six developing devices 41-46 are mounted in the rotary unit 4A. The six developing devices 41-46 are: a cyan developing device 41 in which dark cyan toner, as developer, is stored; a magenta developing device 42 in which dark magenta toner is stored; a yellow developing device 43 in which yellow toner is stored; a black developing device 44 in which black toner is stored; a light cyan developing device 45 in which light cyan toner is stored; and a light magenta developing device 46 in which light magenta toner is stored.

That is, the image forming apparatus in this embodiment uses two kinds of magenta toner, which are the same in hue, but different in lightness, and two kinds of cyan toner, which are the same in hue, but different in lightness. More specifically, it is provided with: dark toner developing devices 41 and 42, and light color toner developing devices 45 and 46. In the dark toner developing devices 41 and 42, the dark magenta toner, as the toner (dark color toner) which is lower in lightness, and the dark cyan toner, as the toner (dark color toner) which is lower in lightness, are stored, respectively. In the light color toner developing devices 45 and 46, the light magenta toner, as the toner (light color toner) which is higher in lightness, and the light cyan toner, as the toner (light color toner) which is higher in lightness, are stored, respectively. In this embodiment, the yellow developing device 43 and black developing device 44, which do not have counterparts that are the same in hue, but different in lightness, are treated as dark color toner developing devices.

Incidentally, the statement that two toners are the same in hue, but different in lightness means that the two toners are equal in the spectral characteristics of the coloring ingredient (pigment) contained in the toner, which is basically made up of resin and coloring ingredient (pigment), and are different in the amount of the coloring ingredient. The statement that one toner is higher in lightness than the other means that of the two toners which are the same in hue, but are different in lightness, the former is relatively lower in density.

Further, the statement that two toners are the same in hue means that the two toners are the same in the spectral characteristics of the coloring ingredient, as described above. However, the statement does not mean that the two are exactly the same in the spectral characteristics of the coloring ingredient; it means that the two toners are the same in color, for example, magenta, cyan, yellow, or black, in terms of the normal color perception.

In this embodiment, of two toners which are the same in hue, the toner which is higher in lightness is the one which is no more than 1.0 in the post-fixation optical density (when amount of toner on the recording medium is 0.6 mg/cm$^2$), and the toner which is lower in lightness is the one that is no less than 1.0 in the post-fixation optical density (when amount of toner on the recording medium is 0.6 mg/cm$^2$).

In this embodiment, in the case of the dark cyan toner, dark magenta toner, yellow toner, and black toner, which are dark color toners, the amount of pigment is adjusted so that when the amount of each toner borne on recording medium is 0.6 mg/cm$^2$, the post-fixation optical density of the toner is 1.8. The light cyan toner and light magenta toner, which are light color toners are designed so that when the amount of each toner borne on recording medium is 0.6 mg/cm$^2$, the post-fixation optical density of the toner is 0.9. The different levels of gradation of each color are reproduced by adjusting the ratio at which the dark and light toners are used in mixture.

The developers stored in the above-mentioned developing devices 41-46 are two-component toners, that is, mixtures of a toner and a carrier. Even if these developing devices 41-46 are filled with single-component toners, that is, pure toner, there will be no problem. Further, in this embodiment, the cyan toners, which are different in lightness, and the magenta toners, which are different in lightness, are used. However, the colors for which toners different in lightness are provided do not need to be limited to the above-mentioned two colors. That is, the color for which toners different in lightness are provided may be only cyan, magenta, or yellow, or all colors may be provided with toners different in lightness. In other words, any color or any combination of colors may be provided with toners different in lightness. Further, in this embodiment, the number of developing devices is six because of the number of colors and the number of color toners. However, the number of developing devices does not need to be limited to this number.

The above-described intermediary transfer belt 5 is stretched around a driver roller 51, a pair of tension rollers 52 and 54, and a secondary transfer counter roller 53. On the inward side of the loop which the intermediary transfer belt 5 forms, a primary transfer roller 50 is disposed, which presses the intermediary transfer belt 5 upon the photosensitive drum 1. Further, a secondary transfer roller 55 is disposed on the outward side of the loop of the intermediary transfer belt 5, opposing the secondary transfer counter roller 53.

In the bottom portion of the printer portion A, feeder cassettes 11, 12, and 13, feed rollers 14, 15, and 16, conveyance rollers 17, 18, and 19, and a pair of registration roller 20, are disposed, listing from the upstream side in terms of the direction in which a sheet of a recording medium, that is, the object on which an image is formed, is conveyed. Further, a conveyance belt 21 stretched around rollers 22 and 23, a heat roller type fixing apparatus 9, which is the first image heating means, a pair of discharge rollers 24, etc., are disposed in the printer portion A. The heat roller type fixing apparatus 9 has a fixation roller 91, a pressure roller 92, and a fixation roller cleaner 93. Also disposed in the printer portion A are a two-sided printing conveyance path 25, a manual feeder tray 26, a feed roller 27, etc.

In the reader portion B, an original placement glass platen 31, an original pressing pressure plate 32, an exposure lamp 33, full reflection mirrors 34, 35, and 36, a lens 37, a full-color CCD sensor 38, etc., are disposed.

When forming an image with the use of the above-mentioned image forming apparatus, an original is placed on the original placement glass platen 31 in the reader portion B, with the image bearing surface of the original facing downward. Then, the original is pressed by the original pressing plate 32. Then, the image bearing surface of the original is illuminated by an exposure lamp 33, which is moved in manner of scanning the original. The light reflected by image bearing surface of the original is focused onto the full-color sensor 38 by the lens 37, obtaining color separation picture signals. The color separation picture signals are sent to a video signal processing unit (unshown) through an amplification circuit (unshown). In the video signal processing unit, the color separation picture signals are processed. Then, the processed color separation picture signals are sent out to the printer portion A through an image memory (unshown).

To the printer portion A, the picture signals from a computer, which is an external device, the picture signals from a fax, etc., are sent in addition to the signals from the reader portion B.

Next, the operation of the printer portion A will be described, assuming that the picture signals are sent from the reader portion B.

In the image forming operation, the photosensitive drum 1 is rotationally driven by a driving means (unshown) in the direction indicated by an arrow mark at a preset process speed (peripheral velocity). As the photosensitive drum 1 is rotationally driven, its surface is uniformly charged to a preset polarity and potential level by the primary charging device 2 (charging process).

After the charging of the surface of the photosensitive drum 1, an electrostatic latent image is formed on the surface of the photosensitive drum 1 by the laser-based optical exposing system 3. The picture signals from the reader portion B are converted into optical signals by a laser beam outputting portion (unshown). The beam of laser light outputted while being modulated by the picture signals is reflected by a polygon mirror 3*a*, transmitted through the lens 3*a*, reflected by the full reflection mirrors 3*c*, and projected onto the charged surface of the photosensitive drum 1. In other words, the peripheral surface of the photosensitive drum 1 is exposed by a laser-based optical exposing system, per each of the colors into which the optical image of the original is separated. As a result, an electrostatic latent image is formed, per color, on the peripheral surface of the photosensitive drum 1 (exposing process).

Next, the rotary unit 4A is rotated to move a specific developing device into the position in which the developing device is enabled to develop the latent image on the surface of the photosensitive drum 1. In this position, or the development position, the developing device is operated to develop the latent image on the photosensitive drum 1, into a visible image; a visible image is formed of the developer, the essential ingredients of which are resin and pigment, on the photosensitive drum 1 (this visible image may be referred to as developer (toner) image) (developing process).

Incidentally, referring to FIG. 1, the developing devices 41-46 are replenished, with preset timing (or as necessary), with the toners from the toner storage portions (hoppers) 61-66 disposed above the laser-based optical exposing system 3, in order to keep constant the toner ratio (or amount of toner) in the developing devices 41-46, respectively. Above the photosensitive drum 1, a photosensor 70, as a density detecting means, is disposed, making it possible to detect the amount of the toner on the photosensitive drum 1.

After the toner image is formed on the photosensitive drum 1 through the above described processes, the toner image is transferred (primary transfer) onto the intermediary transfer belt 5 by the primary transfer roller 50 (primary transfer process). After the transfer of the toner image, the toner (residual toner) remaining on the surface of the photosensitive drum 1 is removed by the cleaning apparatus (cleaning process) to use the photosensitive drum 1 for the formation of the image of the next color. Each of the above described image formation processes, that is, the charging process, the exposing process, the developing process, the primary transferring process, and the cleaning process, is repeated in the same manner as that described above, for the necessary colors among the abovementioned six colors. As a result, multiple toner images different in color are placed in layers on the intermediary transfer belt 5.

The toner images placed in layers on the intermediary transfer belt 5 are transferred all at once (secondary transfer) onto a sheet of recording medium by the secondary transfer roller 55 (secondary transferring process). The sheet of the recording medium is fed into the main assembly of the image forming apparatus from the feeder cassette selected among the feeder cassettes 11-13, and is supplied by the pair of registration rollers 20 to the secondary transfer station, which is the interface between the intermediary transfer belt 5 and secondary transfer roller 55, with such a timing that the arrival of the recording medium at the secondary transfer station coincides with the arrival of the toner images on the intermediary transfer belt 5 at the secondary transfer station. After the transfer of the toner images, the toner (residual toner) remaining on the surface of the intermediary transfer belt 5 is removed by a belt cleaner 56 in order to prepare the intermediary transfer belt 5 for the next primary transferring process.

The image forming apparatus 10 is provided with a sensor 57 for detecting the positional deviation of the image transferred from the photosensitive drum 1, and the density of the image transferred from the photosensitive drum 1. The sensor 57 is disposed in the adjacencies of the outward surface of the intermediary transfer belt 5 in terms of the loop which the intermediary transfer belt 5 forms, opposing the follower roller 52. The image density, the amount of toner that is supplied, the image writing timing, the image writing starting line, etc., are adjusted, as necessary, by the control portion of (unshown) of the main assembly of the image forming apparatus, based on the results of the detection by the sensor 57.

After the toner images are transferred onto the recording medium through the processes such as those described above, the recording medium is conveyed by the conveyance belt 21 to the heat roller type fixing apparatus 9 as the first image heating means. In the heat roller type fixing apparatus 9, the recording medium is fed into the fixation nip between the fixation roller 91 (rotatable heating member) and pressure roller 92 (rotatable pressure applying member). In the fixation nip, the recording medium is heated and pressed. As a result, the toner images are fixed to the surface of the recording medium.

When forming an image on both surfaces of the recording medium, a conveyance path guide (unshown) is driven to temporarily guide the recording medium into a reversal path 29, through the conveyance path 28, immediately after the passing of the recording medium through the heat roller type fixing apparatus 9. Then, a reversal roller 30 is rotated in reverse to retract the recording medium in the direction opposite to the direction in which the recording medium was sent into the reversal path 29 (in other words, the recording medium is moved so that the edge of the recording medium, which was the trailing edge when the recording medium was sent into the reversal path 29, becomes the leading edge), so that the recording medium is sent into the two-sided printing conveyance path 25. Thereafter, the recording medium is moved through the two-sided printing conveyance path 25, and is conveyed by the two-sided printing conveyance rollers to the pair of registration rollers 20 with a preset timing, while being corrected in attitude (if it is askew). Then, toner images are transferred onto the other side of the recording medium, through the above-described image formation processes. Then, the toner images are fixed, ending the image forming operation for forming an image on both surfaces of the recording medium.

Figure 3:
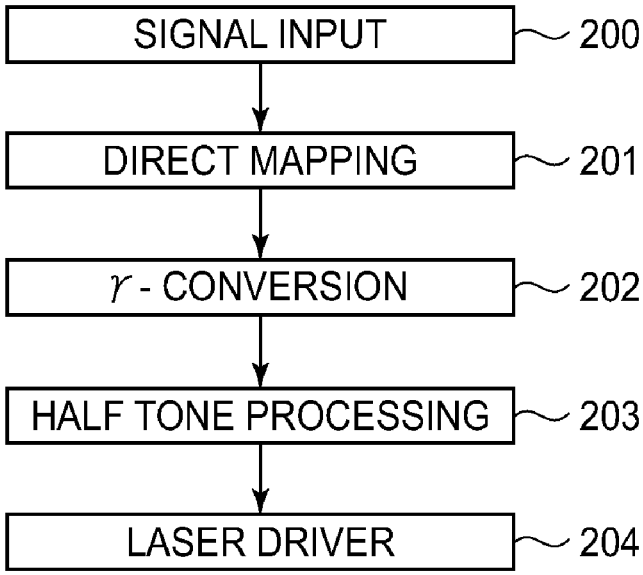
FIG. 3 is a block diagram of an example of the image formation process of an image forming apparatus.

Referring to FIG. 3, which is a block diagram of the image forming process of the image forming apparatus in this embodiment, an input signal 200 is the picture signal from the above described reader portion B. Incidentally, when the image forming apparatus is used as a printer, or a part of a facsimile machine, the picture signal from an external device, such as a computer or facsimile machine, connected to the image forming apparatus through a communication cable is equivalent to the input signal 200. This input signal 200 is an RGB signal, and is inputted into a direct mapping portion 201, in which the process for separating the RGB into four colors, that is, YMCK, is carried out.

Next, the process for separating the YMCK into six colors, that is, dark cyan, dark magenta, yellow, light cyan, light magenta, and black, is carried out in a gamma conversion portion 202; and the picture data are converted into signals which correspond to image density, in the gamma conversion portion 202.

Thereafter, the picture data are subjected to the halftone processing (more specifically, dithering process), in the halftone processing portion 203.

After the completion of the above described processes, a laser driver 204 is driven based on the signals from the halftone processing portion 203. As a result, the charged surface of the photosensitive drum 1 is exposed in accordance with the laser-based optical exposing system 3, in accordance with the picture data.

Figure 4:
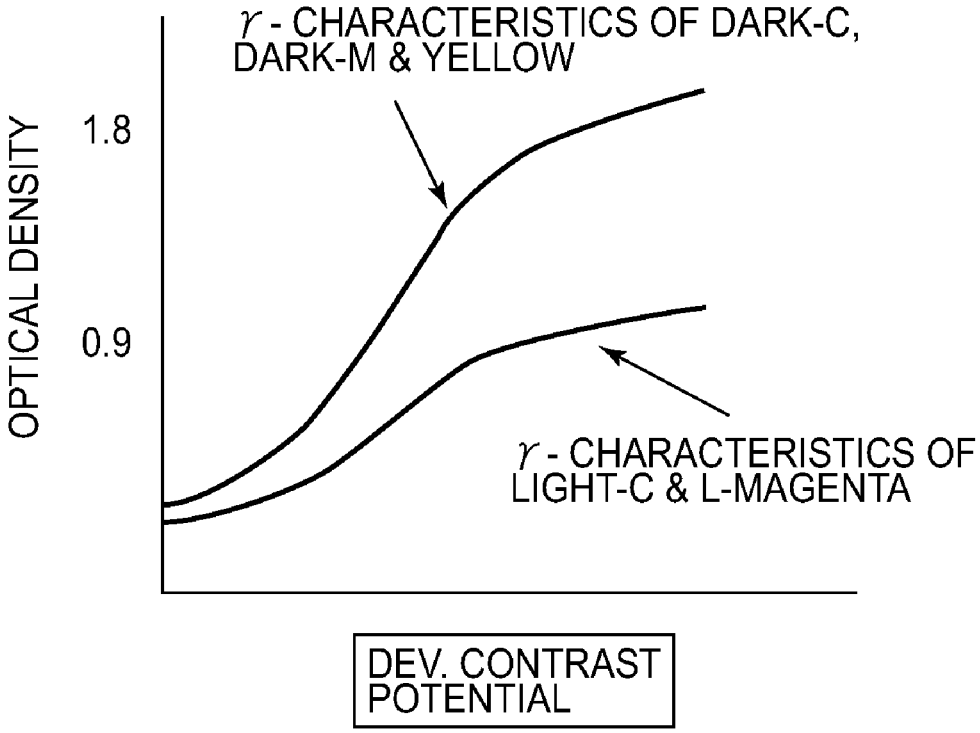
FIG. 4 is a graph which shows the examples of the gamma characteristics of the toner of a light color, and the gamma characteristics of the toner of a dark color.

FIG. 4 is a graph showing the gamma characteristics of the dark colors and light colors. In FIG. 4, the development contrast voltage (the amount of the difference in the DC voltage component between potential level of an exposed point and the development bias) of the image forming apparatus in this embodiment is represented by the axis of the abscissas, and the density is represented by the ordinate axis. More specifically, as described above, the dark cyan, dark magenta, and yellow toners are adjusted so that when they are borne on the recording medium by 0.6 mg/cm$^2$, the density is 1.8. Further, the light cyan and light magenta toners are adjusted so that when they are borne on the recording medium by 0.6 mg/cm$^2$, the density is 0.9.

Figure 5:
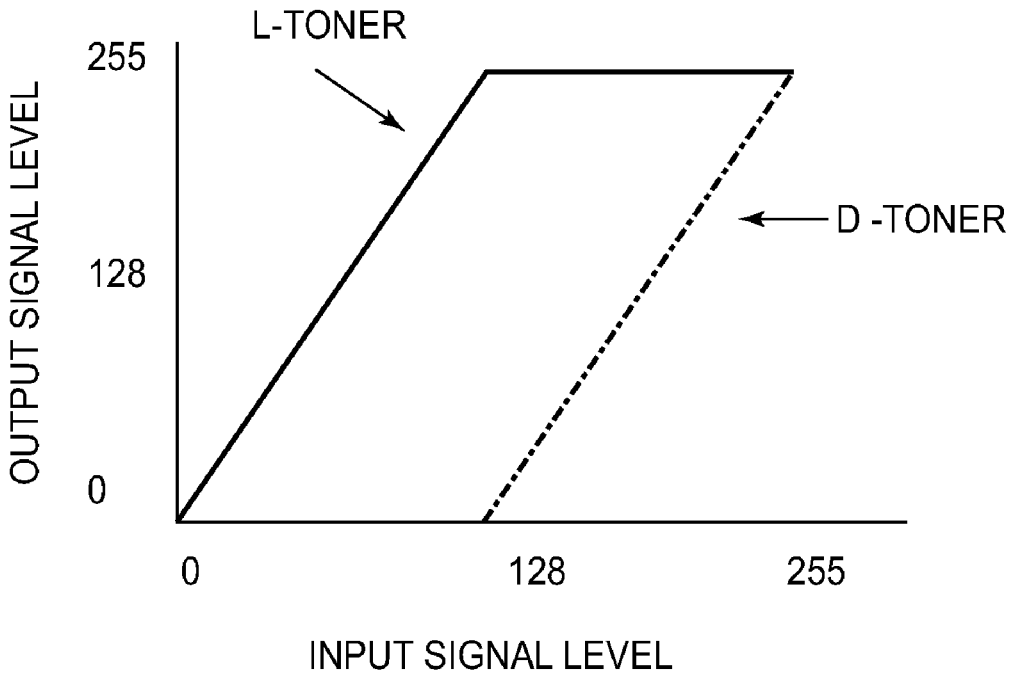
FIG. 5 is a graph which shows the relationship between the input and output signal levels of the light toner, and the relationship between the input and output signal levels of the dark toner, where the input signal has 256 levels (0-255: 8 bits).

Next, the color processing in which two toners, which are the same in hue, but different in lightness (that is, dark and light toners) are used, will be described. Referring to FIG. 5, the abscissa axis corresponds to the level of the input signal 200, and the ordinate axis corresponds to the level of the signal outputted from the gamma conversion portion 202.

FIG. 5 shows the ratio of the light cyan output signal to the light cyan input signal, and the ratio of the dark cyan output signal to the dark cyan input signal. There are 256 levels of cyan gradation: 0-255 (eight bit). The magenta image is formed using the same ratio between the light and dark toners as that for the cyan image. By outputting picture signals using the method described above, the light area of the cyan image and the light area of the magenta image are formed of the light toner alone, whereas the dark area (darker than halftone area) of the cyan image and the dark area of the magenta image are outputted with the use of the combination of the light and dark toners. Incidentally, the image forming apparatus may be set up so that when the light area of an image is formed, the light toner is used as the main toner while the dark toner is used as the subordinate toner, whereas when the dark areas of the image is formed, the dark toner is used as the main toner while the light toner is used as the subordinate toner.

Forming the light area of an image with the use of the light toner alone as described above eliminates the periodicity which is the main cause of the formation of an image inferior in graininess, because of the following reason. That is, when the light area of an image is formed of the light toner alone, each picture element comes out light. Therefore, even if the halftone area, which suffers from periodicity, which is the main cause of the formation of an image inferior in graininess, is formed by dithering, the periodicity is unlikely to be visually recognizable. Further, the area of an image, which is higher in density than the halftone area, is greater in the amount of the toner (outputted as solid area). Therefore, the periodicity that is the main cause of the formation of an image inferior in graininess is eliminated.

For the reasons given above, using the combination of two toners which are the same in hue, but different in lightness, instead of using the dark toner alone as in the past, makes it unlikely for the periodicity to be visually recognized, making it thereby possible to form an image superior in terms of graininess, that is, an image which is less grainy.

By carrying out the color developing process using two toners which are the same in hue, but different in lightness (in other words, by using dark and light toners), the process grey area of an image, which is no higher in output image density than 1.0, can be reproduced so that its graininess level R is in the range of 0.5-4.0.

Incidentally, the phrase "process grey area of an image" refers to the area of the image that is affected when the R (red), G (green), and B (blue) signals among the above-described input signals are equal. Further, the process grey area of the image is the area of the image that is the black area of an image formed without using the black toner, that is, the black area formed with the use of only yellow, magenta, and cyan color toners. In other words, the low density process grey area of the image, that is, the process grey area that is no higher than 1.0 in output image density, is the black area of the image formed of mainly the light toners. In this embodiment, the low density process grey area of an image, which is no higher than 1.0 in output image density, is the black area of the image formed with the use of three kinds of toners, that is, (dark) yellow toner, light magenta toner, and light cyan toner.

Here, the term "periodicity" means the appearance of a periodic pattern, such as a pattern formed by scanning lines, which is attributable to the halftone processing of the amplitude modulation type, which is commonly referred to as AM screening. The above-described periodicity is unlikely to be noticeable when the halftone processing of the frequency modulation type, which is commonly referred to as FM screening, is used.

Further, referring to FIG. 1, the image forming apparatus in this embodiment is provided with an optional unit 100 having a belt type fixing apparatus 110 used when forming an image on a sheet of recording medium, which has a transparent surface layer formed of thermoplastic.

That is, connecting the optional unit 100 to the image forming apparatus, as shown in FIG. 1 yields an electrophotographic image formation system (image quality improvement system), that is, an image formation system (image quality improvement system) equipped with both the above-described heat roller type fixing apparatus 9, which is the first image heating means, and the belt type fixing apparatus 110, which is the second image heating means. The belt type fixing apparatus 110 will be described later.

Next, the optional unit 100, equipped with the belt type fixing apparatus 110, will be described in detail.

In the optional unit 100, a switching guide 101 is disposed in addition to the belt type fixing apparatus 110. After a sheet of the recording medium is subjected to the fixation process by the heat roller type fixing apparatus 9, the switching guide 101 conveys the recording medium toward a delivery tray 102, which makes up a part of the top surface of the optional unit 100, or toward the belt type fixing apparatus 110. The optional unit 100 is also provided with a delivery tray 103, onto which the recording medium is mounted after being processed by the belt type fixing apparatus 110. The delivery tray 103 is attached to the side wall of the optional unit 100. Further, the optional unit 100 is provided with roller pairs 104, 105, and 106 for conveying the recording medium, which are optimally positioned.

Figure 2:
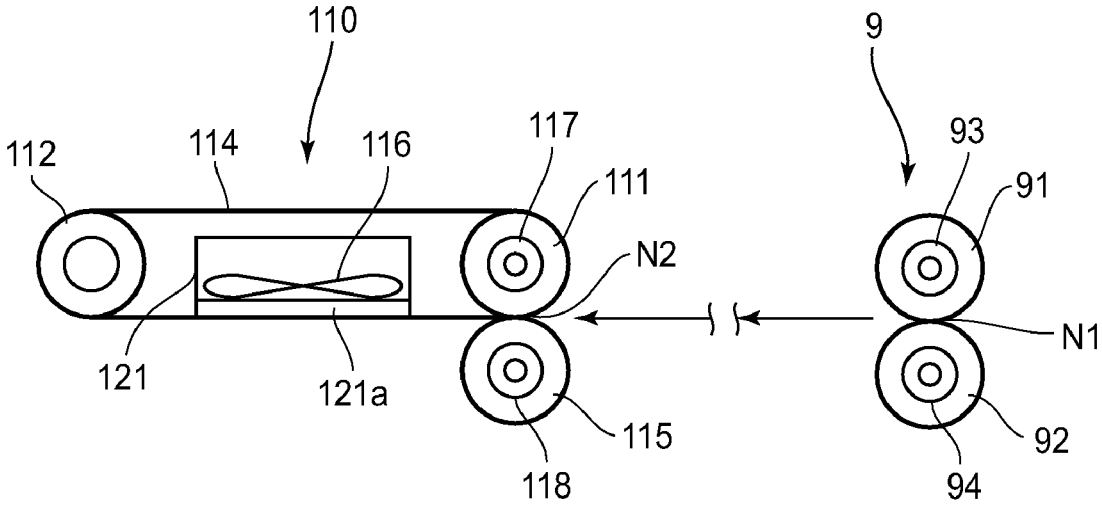
FIG. 2 is a schematic sectional view of a fixing apparatus of the heat roller type, and a fixing apparatus of the fixation belt type.

FIG. 2 is a schematic sectional view of the belt type fixing apparatus 110 (which may be referred to as glossiness improving apparatus), which is the second image heating means.

The belt type fixing apparatus 110 has a fixation belt 114, which is an endless belt for heating the toner image on the recording medium, and a heating means for heating this belt 114.

In this embodiment, a heat roller 111, which is a rotational heating member having a heat source, is employed as the heating means. In this embodiment, a halogen lamp is disposed, as a heat source, in the hollow of the heat roller 111. However, a heat source other than a halogen lamp may be employed as the heat source.

This heat roller 111 also functions as the drive roller for driving the belt 114. The optional unit 100 is structured to input a driving force into the heat roller 111 through a gear train so that the belt 114 is moved at a peripheral velocity of 50 mm/sec. Therefore, the recording medium conveyance speed of the belt type fixing apparatus 110 is 50 msec, which is substantially slower than that of the heat roller type fixing apparatus 9, which is 300 mm/sec. That is, the fixation conditions for the belt type fixing apparatus 110, under which a toner image is fixed by the belt type fixing apparatus 110, are set so that a sheet of the recording medium having a toner reception layer is discharged from the optional unit 100 after a toner image is fully fixed to the recording medium, as will be described later.

The belt type fixing apparatus 110 is also provided with a separation roller 112, which is disposed, with the presence of a preset amount of a gap between the separation roller 112 and heat roller 111. The fixation belt 114 is stretched around these two rollers 111 and 112. Incidentally, the separation roller 112 also functions as the tension roller that provides the fixation belt 114 with a preset amount of tension.

The pressure roller 115, which is a rotational pressure applying member, is disposed so that it is kept pressed against the heat roller 111, with the fixation belt 114 pinched between the two rollers 111 and 115.

Further, the belt type fixing apparatus 110 is provided with a cooling fan 116 and a cooling duct 121, which constitute a cooling means for forcefully cooling a sheet of the recording medium while the sheet moves with the fixation belt 114, remaining flatly in contact with the fixation belt 114. The cooling fan 116 and cooling duct 121 are disposed on the inward side of the loop which the fixation belt 114 forms, and are located between the heat roller 111 and separation roller 112. The cooling duct 121 is provided with cooling fins 121*a*, on which the inward surface of the fixation belt 114 slides as the fixation belt 114 moves. As the recording medium moves with the fixation belt 114 while remaining flatly in contact with the fixation belt 114, it is sufficiently cooled by the cooling means. Then, the recording medium is separated from the fixation belt 114 at a separation area which corresponds in position to the separation roller 112.

The heat roller 111 has three coaxial cylindrical layers: a core portion, an elastic layer, and a release layer. The core portion is a piece of hollow aluminum pipe, which is 44 mm in diameter and 5 mm in thickness. The elastic layer is formed of silicon rubber. It is 50 degrees in hardness (JIS-A) and 300 μm in thickness. The release layer is formed of PFA, and is 50 μm in thickness. In the hollow of the core portion, a halogen lamp 117 is disposed as a heat source (roller heating heater). Incidentally, the heat source does not need to be limited to a halogen heater. For example, a heating means structured to heat the heat roller with the magnetic flux generated by an exciter coil, that is, a heating means which heats the heating roller by electromagnetic induction, may be employed.

The pressure roller 115 has roughly the same structure as that of the heat roller 111. The elastic layer of the pressure roller 115 is formed of silicon rubber, and is 3 mm in thickness. This is for making sufficiently wide (in terms of recording medium conveyance direction) the nip which the elastic layer forms as the second heating nip N2. In the hollow of the core portion, that is, the piece of hollow pipe, of the pressure roller 115, a halogen lamp 118 is disposed as a heat source (roller heating heater).

The heat roller 111 and the pressure roller 115 are kept pressed against each other, with the fixation belt 114 pinched between them, by the application of a preset amount of pressure, forming a nip with a preset width (in terms of the recording medium conveyance direction), which constitutes the second heating nip N2 as a heating-and-pressure applying portion. In this embodiment, the total amount of pressure applied by the pressure roller 115 to the heat roller 111 is set to 490 N (50 kgf). The width (the dimension in the recording medium conveyance direction) of the heating nip N2 was 5 mm. In order to form a highly glossy image, the surface of the fixation belt 114, with which the image formed on the recording medium is placed in contact, is rendered flat and smooth like the surface of a mirror. Thus, the fixation belt 114 may be called a glossy belt. More specifically, the surface of the fixation belt 114 in this embodiment, with which the image bearing surface of the recording medium is placed entirely in contact, is no less than 60 in glossiness (the method for measuring glossiness is similar to the method which will be described later).

Further, the fixation belt 114 in this embodiment is made up of polyimide film, an elastic layer formed of silicon rubber, on the polyimide film, and a release layer formed of polyimide-silicon resin, on the elastic layer.

The belt type fixing apparatus 110 in this embodiment is structured so that the fixation belt 114 is cooled by the cooling air flowed through the cooling duct 121 by turning on the cooling fan 116. Thus, the recording medium (and toner image thereon) is forcefully and sufficiently cooled as it moves with the fixation belt 114 while remaining flatly in contact with the fixation belt 114. Incidentally, the cooling means does not need to be provided with the above-described cooling fin. For example, it may be provided with only the cooling fan, which cools the fixation belt 114 without contacting the fixation belt 114. Further, a Peltier element, a heat pipe, or a cooling apparatus of the water circulation type, may be used as the cooling means.

As the recording medium used with the fixing apparatus of the belt type, a resin-coated paper is used, which is made up of a sheet of ordinary recording paper, as a substrate layer, and a layer of thermoplastic resin, as the toner reception layer, coated on the substrate layer. Hereafter, this type of recording medium or the like will be referred to as photographic medium.

The recording medium used in this embodiment is made up of a sheet of ordinary recording paper as the substrate layer, a layer of polyethylene resin coated on the substrate layer, and another layer of resin compatible with toner in terms of mutual solubility, coated on the polyethylene layer. As the resin which is compatible with toner in that they are soluble into each other, a polyester resin, which is the same in main ingredient as toner, is used. The amount of this polyester resin is roughly 15 g/m$^2$; the overall basis weight of the recording medium is 200 g/m$^2$. The toner reception layer of the recording medium is compatible with toner, and is characterized in that as it is heated by the belt type fixing apparatus 110, it softens (melt) with toner. In this embodiment, the same polyester resin as the material for the toner is used as the material for the toner reception layer. The toner reception layer of the recording medium in this embodiment is a transparent layer which contains thermoplastic resin, and is no less than 5 μm and no more than 30 μm in thickness. That is, the toner reception layer is rendered transparent so that it does not affect image formation.

Therefore, while heat and pressure are applied by the belt type fixing apparatus 110, the toner reception layer softens with the toner, allowing the toner image to be inlaid into the toner reception layer. After the toner image is inlaid into the toner reception layer, the recording medium remains entirely in contact with the fixation belt 114, until the toner image is fully cooled. Therefore, the image bearing surface of the recording medium conforms to the surface of the fixation belt 114, which is as flat and smooth as the surface of a mirror, becoming as flat and smooth as the surface of a mirror, and therefore, improving the image on the recording medium in glossiness.

Incidentally, in this embodiment, the phrase "glossiness of an image" means the glossiness of the image bearing surface of the recording medium (photographic medium). That is, the statement that an image formed by an electrophotographic image forming apparatus is as high in glossiness as an image formed by silver salt photography is synonymous with the statement that there is virtually no step between an area of a photographic medium, which is covered with toner, and an area of the photographic medium, which is not covered with toner.

The reason why a belt type fixing apparatus is used when a photographic medium, such as the above-described one, is used for image formation, is that when such a medium is used, a cooling apparatus is necessary.

In other words, if the amount of heat necessary to inlay a toner image into the toner reception layer is supplied by a heat roller type fixing apparatus, the resin which forms the surface layer of the recording medium melts, becoming thereby higher in viscosity. Therefore, the amount of the force which keeps the recording medium adhered to the heat roller increases, making it difficult for the recording medium to separate from the heat roller.

Therefore, the conditions under which a heat roller type fixing apparatus is operated must be set to allow the photographic medium to easily separate from the heat roller of the heat roller type heating apparatus, so that the recording medium can be conveyed to the belt type fixing apparatus, by which the recording medium is heated, and then, is cooled to be separated from the fixation belt.

Figure 6:
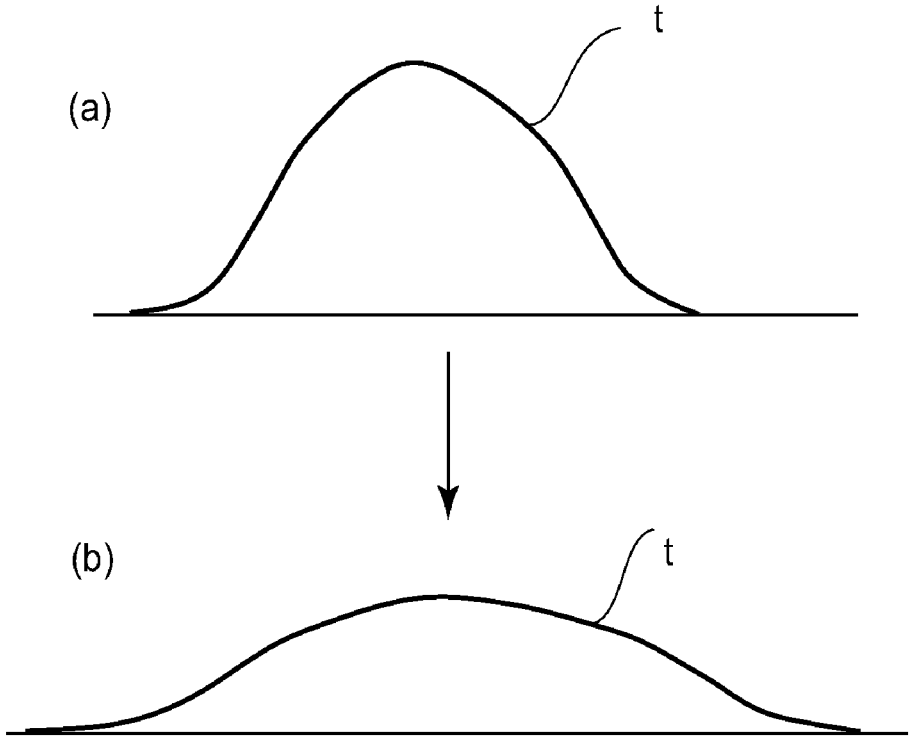
FIG. 6 is a schematic sectional view of the toner layer on the recording medium, showing the state thereof.

However, it was discovered that even when a heat roller type fixing apparatus is operated under the conditions under which a photographic medium easily separates from the heat roller, changes occurs to the state of the toner image on the photographic medium as the toner is softened, which affects the state in which the toner image is fixed by the belt type fixing apparatus. To describe this phenomenon in more detail, the toner layer on the recording medium heats up before the toner reception layer of the recording medium heats up. Therefore, if the recording medium is subjected to excessive amounts of heat and pressure in the heat roller type fixing apparatus, the toner layer t excessively spreads in the horizontal direction, that is, the direction parallel to the surface of the recording medium, before it is inlaid into the toner reception layer, as shown in FIG. 6(*b*). As the toner layer t excessively spreads in the horizontal direction, the non-uniformity in the thickness of the toner layer t becomes conspicuous, making the image appear grainier. In other words, if the toner layer on the recording medium is squashed so that it spreads in the direction parallel to the surface of the recording medium, the toner image becomes inferior in terms of graininess, even if the toner layer is inlaid into the toner reception layer of the recording medium when heat and pressure are applied by the belt type fixing apparatus. That is, even though the image is improved in terms of glossiness, it is reduced in quality in terms of graininess, making it impossible to obtain an image which is as excellent in terms of graininess and glossiness as an image obtained by silver salt photography. On the other hand, when the amount of heat and pressure applied by the heat roller type fixing apparatus is excessively small, such a problem that the toner image on the recording medium is transferred onto the pressure roller, and/or that the toner image on the recording medium adheres to the conveyance rollers or the like, before it reaches the belt type fixing apparatus, occurs.

Therefore, the inventors of the present invention earnestly examined the above-described problems to improve the image forming apparatus in image quality, that is, to provide an image forming apparatus capable of yielding an image of improved final image quality, more specifically, yielding a final image whose graininess level and glossiness level are in the range of 0.5-4.0 and the range of 60-100, respectively. As a result, it became evident that the glossiness level achievable by a heat roller type fixing apparatus without rendering an image inferior in graininess while assuring that the toner reception layer is heated enough for the toner layer to be fixed to the recording medium at the lowest level of satisfactory adhesion (the lowest level of adhesion at which toner layer does not shift, or separate from recording medium, during recording medium conveyance), was in the range of 5-40.

In the case of the image forming apparatus in this embodiment, the operational conditions of the heat roller type fixing apparatus 9 are set so that after the fixation of a toner image, the glossiness level G of the toner image will be in the range of 5-40 ($5 \leqq G \leqq 40$), and the graininess level R of the toner image will be in the range of 0.5-4.0 ($0.5 \leqq R \leqq 4.0$). Further, the operational conditions of the belt type fixing apparatus 110 are set so that after the fixation of a toner image, the graininess level R of the toner image will be no more than 4.0, and the glossiness level G of the toner image will be no less than 60.

In other words, the first fixation process, which is for heating and pressing a toner image, is carried so that the glossiness level G of the toner image transferred onto the recording medium will be in the range of 5-40 ($5 \leqq G \leqq 40$), and the graininess level R of the toner image will be in the range of 0.5-4.0 (0.5≦R≦4.0). Then, the second fixation process, which is for further heating and pressing the toner image, is carried out to improve in glossiness the toner image on the recording medium, which has been heated and pressed in the first fixation process, without rendering the toner image inferior in graininess. In other words, by employing an image quality improving method which yields a toner image which is no more than 4.0 in the final graininess and no less than 60 in the final glossiness, it is possible to obtain a highly glossy image which is as high in image quality as an image formed by the aforementioned silver salt photography. Hereafter, this method will be described in detail.

First, the quality of an image formed by an electrophotographic image forming apparatus will be described in terms of photographic terms. Here, the statement that an image has a photographic level of image quality means that an image on the recording medium is no more than 4.0 in the graininess level R defined in ISO13660, and no less than 60 in the glossiness level R defined in ISO13660. More specifically, the graininess level R of the toner image is in the range of 0.5-4.0 (0.5≦R≦4.0), and glossiness level G of the image is in the range of 60-100 (60≦G≦100).

In order for an image formed by an electrophotographic image forming apparatus to be as high in image quality as an image formed by silver salt photography, the image formed by an electrophotographic image forming apparatus must be equal in graininess to an image formed by silver salt photographic, when it is seen with the naked eye. Basically, the smaller the value of the graininess level of an output image, the better the outputted image. However, from the viewpoint of the cost for substantially reducing an image forming apparatus in the graininess level at which it forms an image, there is little need for reducing the graininess level at which an image forming apparatus forms an image, to a level lower than the level below which the graininess is undetectable to the naked eye. It became evident through the studies made by the inventors of the present invention that from the standpoint of graininess, as long as the graininess level R (defined in ISO13660) of an image is within the range of 0.5-4.0, the image can be said to have a level of image quality virtually equal to that of an image formed by silver salt photography (FIG. 7(*a*)).

An image which is superior in terms of the reproduction of fine details is inferior in the value of graininess level. This means that the image appears grainy to the naked eye. In comparison, a so-called photographic image is an analog image. Therefore, a photographic image which is greater than 4 in the value of its graininess level R is grainy, and therefore, its periodicity is conspicuous. Thus, it gives an impression close to that of a printed image; it is difficult to accept it as a photographic image.

From the viewpoint of graininess, an unsharp image formed with the use of only the dark toner is satisfactory in that it looks like an image formed by silver salt photography. However, such an image is inferior not only in sharpness, but also, in the value of the level of mottle, attributable to low frequency noise, which is lower in frequency than the graininess defined in ISO13660. Therefore, its quality cannot match the quality of a photographic image, in terms of overall image quality. On the other hands, when an image is formed with the use of light toners through the color processing shown in FIG. 3, it is possible to form an image which is satisfactory in graininess, sharpness, and mottle value, for the following reason. That is, both the dark toner and light toner are capable of reproducing fine details. Further, the light toner is low in density, and when an area of an image is 0.9 in density, this area is outputted as a solid area. Therefore, periodicity does not occur. Therefore, it is superior in graininess. Further, the high density area, which requires sharpness, is sharply reproduced with the dark toner. Therefore, it is neither inferior in sharpness, nor in the reproduction of the low frequency mottle. Therefore, in this embodiment, the upper limit of the graininess level R is set to 4.0.

Further, in principle, the lower the image in graininess, the better the image. However, if the graininess level of an image is no more than 0.5, the superiority of the image in terms of graininess is perceptible. Thus, in consideration of cost, etc., 0.5 is low enough for the graininess level of an image. In this embodiment, therefore, the lowest value for the graininess level is set to 0.5.

On the other hand, in order for an image formed by an electrophotographic image forming apparatus to be as high in image quality as an image formed by silver salt photography, the image formed by an electrophotographic image forming apparatus must be equal in glossiness to an image formed by silver salt photographic. It was discovered through the studies made by the inventors of the present invention that as long as the glossiness level G (defined in ISO13660) of an image formed by an electrophotographic image forming apparatus is in the range of 60-100, the image is roughly equal in glossiness to an image formed by silver salt photography. There are images whose measured glossiness level is as high as 110. However, it is not preferable that an image is higher in glossiness level G than 100, because if an image is higher in glossiness level G than 100, the amount by which light is reflected by the image bearing surface is excessive, possibly giving a viewer an unpleasant impression. Further, for the purpose of making the scratches or the like less conspicuous, the glossiness level G is desired to be no more than 90 (FIG. 7(*b*)), preferably, in a range of 60-90.

Incidentally, the abovementioned graininess level R of an image was measured by a Personal_IAS (product of QEA Co., Ltd.). The glossiness level G of 60 was the glossiness level measured by a PG-1M (product of Nippon Denshoku Co., Ltd.).

Next, referring to FIG. 2, the heat roller type fixing apparatus 9 and belt type fixing apparatus 110, which are for achieving the above-mentioned level of image quality, which is equal to that of an image formed by silver salt photography, will be described regarding their functions.

A toner image is formed on the recording medium having the above-described toner reception layer (polyester resin layer), with the use of the above-described image formation method. This unfixed toner image on the recording medium is temporarily fixed to the recording medium by the heat roller type fixing apparatus 9 of the main assembly 10 of the image forming apparatus (hereafter, this process will be referred to as first fixation).

In the heat roller type fixing apparatus 9, the fixation roller 91 is rotationally driven by a driving mechanism (unshown) in the clockwise direction at a preset velocity (which in this embodiment is 300 mm/s). The pressure roller 92, which opposes this fixation roller 91, is rotated by the rotation of the fixation roller 91.

Further, the fixation roller 91 and the pressure roller 92 are pressed against each other with the application of a preset amount of pressure, forming thereby the first heating nip N1, which has a preset width in terms of the recording medium conveyance direction. In this embodiment, the pressure applied to the fixation roller 91 by the pressure roller 92 is set to 490 N (50 kgf) in total amount. The width of the thus formed heating nip N1 (in terms of recording medium conveyance direction) was 5 mm.

As electrical power is supplied to the halogen lamps 93 and 94 disposed in the hollows of the fixation roller 91 and pressure roller 92, respectively, the fixation roller 91 and the pressure roller 92 are heated by the heating of the halogen lamps 93 and 94, increasing in surface temperature. The surface temperatures of the fixation roller 91 and pressure roller 92 are detected by the corresponding thermistors (unshown). The temperature levels detected by the thermistors are fed back to the control circuit (which in this embodiment is CPU of main assembly of image forming apparatus), which controls the amount of electrical power supplied to the halogen lamps 93 and 94 so that the detected temperature levels, which are inputted from the thermistors (unshown), are maintained at preset temperature levels set for the fixation roller 91 and the pressure roller 92, respectively. That is, the fixation roller 91 and the pressure roller 92 are controlled in temperature so that their temperatures are kept at preset target level to keep the temperature of the first heating hip N1 at a preset level, which in this embodiment is roughly 190 degrees.

Therefore, the recording medium separation temperature (temperature of downstream end portion of fixation nip in terms of recording medium conveyance direction) of the heat roller type fixing apparatus 9 is roughly 190 degrees.

The recording medium sent to the heat roller type fixing apparatus 9 is introduced into the heating hip N1 formed by the fixation roller 91 and the pressure roller 92, and is conveyed through the heating nip N1 while remaining pinched between the fixation roller 91 and pressure roller 92. During this first fixation operation, the toner image is simply fixed to the surface of the toner reception layer by the heating; in other words, it is not heated to a temperature level in the temperature range in which the color toners different in color melt and mix with each other. Further, the toner reception layer of the recording medium remains unmelted, although it is heated enough to make it easier for the toner image to enter the toner reception layer. In other words, the unfixed toner image on the recording medium is temporarily fixed to the recording medium to the above-described level to prevent the toner on the recording medium from transferring onto the conveyance rollers or the like while the recording medium reaches the belt type fixing apparatus.

That is, the optional unit 100 is structured so that when a sheet of the recording medium having the toner reception layer is used, the sheet is reheated and re-pressed by the belt type fixing apparatus 110 after being heated and pressed by the heat roller type fixing apparatus 9. Therefore, the fixation conditions (operation conditions) for the heat roller type fixing apparatus 9 are set to fix the toner image to a degree which is insufficient for discharging the recording medium from the optional unit 100 (into delivery tray 103).

On the other hand, when an ordinary recording medium (80 g/m$^2$ in basis weight) or the like, that is, a recording medium other than the recording medium having the toner reception layer, is used, the fixation process is carried out with the use of only the heat roller type fixing apparatus 9. Therefore, the fixation conditions for the heat roller type fixing apparatus 9 are set so that when an ordinary paper or the like, that is, a recording medium other than the recording medium having the toner reception layer, is used, the toner image is fixed to a degree which is sufficient to discharge the recording medium from the device (into delivery tray 102).

Figures 7, 8:
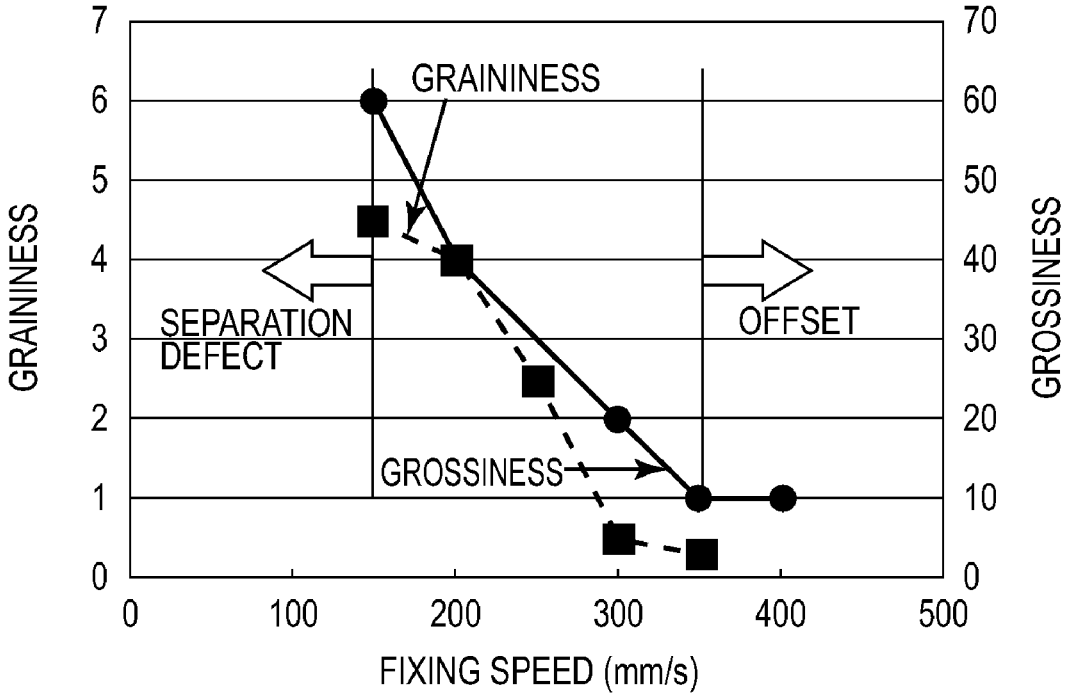
FIG. 7 is a table which shows the results of the image evaluation in terms of graininess and glossiness.
FIG. 8 is a graph which shows the changes in graininess which occurred as the fixation speed was varied under preset conditions.

Next, referring to FIG. 8, an example of an experiment for setting the fixation conditions (operational conditions) for operating the heat roller type fixing apparatus 9 when a recording medium having the toner reception layer will be described. In FIG. 8, the vertical axis on the left side, represents the graininess, and the vertical axis on the right-hand side represents the glossiness. Further, FIG. 8 shows the changes in the graininess and glossiness which occurred as the heat roller type fixing apparatus 9 was varied in fixation speed (mm/sec), in the fixation experiment in which the fixation temperature and fixation pressure of the heat roller type fixing apparatus 9 were set to 190 degrees and 50 kgf, respectively.

According to the results of the experiment shown in FIG. 8, when the fixation speed was no higher than 150 (mm/sec), the amount of heat applied to the recording medium was excessive, causing the recording medium to wrap around the heat roller of the heat roller type fixing apparatus 9. On the other hand, when the fixation speed was higher than 350 (mm/sec), the amount of heat applied to the recording medium was too small, allowing the toner to transfer onto the heat roller type fixing apparatus 9.

Further, the experiment revealed that as long as the fixation speed was in a range of 200-300 (mm/sec), the resultant images satisfied the requirement, in terms of graininess level R, for an image to be as high in quality as an image formed by silver salt photography, that is, $0.5 \leqq R \leqq 4.0$. Thus, the range of glossiness level G, in which the requirement for graininess R, or $0.5 \leqq R \leqq 4.0$, is satisfied, is 5-40 ($5 \leqq G \leqq 40$).

In other words, in order for the heat roller type fixing apparatus 9 to satisfy the requirement for the graininess R, or $0.5 \leqq R \leqq 4.0$, it is desired that the glossiness level G range of the heat roller type fixing apparatus 9 is 5-40 ($5 \leqq G \leqq 40$). That is, the fixation conditions for the heat roller type fixing apparatus 9 are desired to be set to satisfy the requirement for the glossiness level G, that is, $5 \leqq G \leqq 40$.

In this embodiment, the fixation speed of the heat roller type fixing apparatus 9 was set to 300 (mm/sec) in order to reduce the graininess as much as possible. As a result, the graininess level R of the image, more specifically, the graininess level of a process grey area, which was 0.4 in density, was 2.0 after the fixation by the heat roller type fixing apparatus 9. Further, the glossiness level G of the image bearing surface of the photographic medium was 20.

Incidentally, as described above, a process grey area with the density of 0.4 is a black area formed with the use of three kinds of toner: yellow toner, light magenta toner, and light cyan toner.

Also incidentally, the fixation conditions (operation conditions), such as heating condition, the pressing condition, the recording medium conveyance speed, and the recording medium separation temperature, for the heat roller type fixing apparatus 9 do not need to be limited to the above-mentioned values. That is, as long as the state of the image, more specifically, the graininess level R and the glossiness level G of the image on the recording medium after the first fixation satisfies the following requirements: $0.5 \leqq R \leqq 4.0$, and $5 \leqq G \leqq 40$, respectively, the fixation conditions may be different from those described above; they may be optimally set according to the apparatus structure and the like. For example, if the fixation temperature is reduced while keeping fixed the fixation speed and amount of pressing force, the glossiness is reduced while graininess increases. Also, if the amount of the pressing force is reduced while keeping the fixation speed fixed, the glossiness is reduced while the graininess increases. All that is necessary is to optimally set the following fixation conditions (operational conditions) in consideration of the above-described tendencies. More specifically, all that is necessary is to optimally set the fixation temperature (the fixation temperature of the fixing apparatus, that is, the temperature of the fixation roller), the amount of pressing force (the amount of pressure in the fixation nip, that is, the amount of pressure applied to the recording medium), the fixation speed (the recording medium conveyance speed), and the recording medium separation temperature (the temperature level at which the recording medium separates from the fixing apparatus).

Next, the recording medium heated and pressed by the heat roller type fixing apparatus 9 so that its graininess level R and glossiness level G satisfy: $0.5 \leqq R \leqq 4.0$, and $5 \leqq G \leqq 40$, respectively, is made to enter the belt type fixing apparatus 110, in which the recording medium put through the abovementioned first fixation process is reheated and re-pressed (second fixation).

In the belt type fixing apparatus 110, the heat roller 111 is rotationally driven by a driving mechanism (unshown) in the clockwise direction at a preset speed. The fixation belt 114 is rotated in the clockwise direction at a preset speed (which is 50 mm/s in this embodiment), by the rotational driving of the heat roller 111. The separation roller 112 and the pressure roller 115 are rotated by the rotation of the fixation belt 114.

As electrical power is supplied to the halogen lamps 117 and 118 disposed in the hollows of the heat roller 111 and pressure roller 115, respectively, the heat roller 111 and the pressure roller 115 are heated by the heating of the halogen lamps 117 and 118, increasing in surface temperature. The surface temperatures of the heat roller 111 and the pressure roller 115 are detected by the corresponding thermistors (unshown). The temperature levels detected by the thermistors are fed back to the control circuit (which in this embodiment is CPU of main assembly of image forming apparatus), which controls the amount by which electrical power is supplied to the halogen lamps 117 and 118 so that the detected temperature levels, which are inputted from the thermistors (unshown) are maintained at preset temperature levels set for the heat roller 111 and pressure roller 115, respectively. That is, the heat roller 111 and the pressure roller 115 are controlled in temperature so that their temperatures are kept at preset target level to keep the temperature of the second heating nip N2 at a preset level (which in this embodiment is roughly 180 degrees).

Incidentally, here, the image forming apparatus is structured so that the optional unit 100 is controlled with the use of the controlling means (CPU shown in FIG. 1) on the main assembly side of the image forming apparatus. However, the structure does not need to be limited to the above-described one. For example, the structure may be such that the optional unit 100 is provided with a controlling means dedicated to the control of the optional unit 100, or both the main assembly of the image forming apparatus and the optional unit are provided with their own controlling means.

The recording medium sent to belt type fixing apparatus 110 is introduced into the heating nip N2 formed by the fixation belt 114 and pressure roller 115, and is conveyed through the heating nip N2 while remaining pinched between the fixation belt 114 and pressure roller 115. During this second fixation, the transparent resin layer (toner reception layer) is increased in temperature by the heat from the heat roller 111 and pressure roller 115, softening therefore along with the toner. Further, the toner image is inlaid into the transparent resin layer by the pressure applied by the heat roller 111 and pressure roller 115. At the same time, the recording medium is pressed entirely onto the surface of the fixation belt 114. Thus, the image bearing surface of the recording medium, on which the toner image is present, is made to conform to the surface property (being as flat and smooth as surface of mirror), becoming as flat and smooth as the surface of a mirror.

After the toner image is inlaid into the transparent resin layer of the recording medium, the recording medium is conveyed to the separation area while remaining entirely in contact with the surface of the fixation belt 114. While the recording medium is conveyed to the separation area, remaining entirely in contact with the fixation belt 114, from the heating nip N2 to the separation area (cooling area), it is efficiently and forcefully cooled by cooling fan 116. That is, the toner image is cooled to a temperature level (roughly 35 degrees), which is lower than the temperature level (glass transition temperature: roughly 50 degrees) at which the toner softens. This cooling of the toner image, along with the object releasing property of the surface of the fixation belt 114, makes it easier for the recording medium to separate from the fixation belt 114, because the recording medium separation temperature of the belt type fixing apparatus 110 in this embodiment is roughly 35 degrees.

Then, after the recording medium remaining entirely in contact with the surface of the fixation belt 114 is thoroughly cooled in the cooling area, it separates from the fixation belt 114 due to its own rigidity (resiliency), in the separation area where the fixation belt 114 is changed in curvature by the separation roller 112 (separation by curvature).

As the recording medium is separated from the fixation belt 114 after it is thoroughly cooled, the image bearing surface of the recording medium remains as flat and smooth as the surface of the fixation belt 114, which is as flat and smooth as the surface of a mirror, being therefore drastically higher in glossiness, compared to that after the processing of the recording medium by the heat roller type fixing apparatus 9. That is, the fixation conditions (operation conditions) for the belt type fixing apparatus 110 are set so that after the second fixation operation, the state of the image on the recording medium, more specifically, the glossiness level G of the image will be in the range of 60-100 ($60 \leqq G \leqq 100$), while the graininess level R of the image remains in the range of 0.5-4.0 ($0.5 \leqq R \leqq 4.0$). When the belt type fixing apparatus 110 in this embodiment was operated under the above-described heating and pressing conditions, the process grey area of a resultant image, which was 0.4 in density, was 2.0 in graininess level R and 90 in glossiness level G.

Thus, by using the above-described heat roller type fixing apparatus 9 and belt type fixing apparatus 110, it is possible to obtain a high quality image, the graininess level R ($0.5 \leqq R \leqq 4.0$) and glossiness level G ($60 \leqq G \leqq 100$) of which match those of an image formed by silver salt photography.

Up to this point, the image forming apparatus has been described regarding the graininess and glossiness. However, if the image properties, such as line reproducibility, mottling, image stability, etc., that is, the image properties other than the graininess and glossiness, may be ignored, it is sometimes possible to form an image, the graininess and glossiness levels of which are in the above-mentioned ranges. In such a case, however, the image forming apparatus is inferior in line reproducibility, worse in mottling, inferior in image stability, or suffers from the like problems, resulting in the formation of an image, the quality of which is far from matching that of an image formed by silver salt photography, in terms of the balance among the image properties; for example, an image, the lines of which are fatter by 20% than those of a normal image may be formed.

What is important here is to keep the graininess level R in the range of 0.5-4.0 ($0.5 \leqq R \leqq 4.0$), and the glossiness level G in the range of 60-100 ($60 \leqq G \leqq 100$), while keeping each of the abovementioned image properties regarding image quality at a high level.

Incidentally, the fixation conditions, more specifically, the heating condition, the pressing condition, the recording medium conveyance speed, and the recording medium separation temperature, for the belt type fixing apparatus 110 do not need to be limited to the aforementioned values. That is, as long as the fixation conditions are such that the graininess level R and glossiness level G of the image on the recording medium after the second fixation satisfy the following requirements: $0.5 \leqq R \leqq 4.0$, and $60 \leqq G \leqq 100$, respectively, the fixation conditions may be different from those described above; they may be optimally set according to the apparatus structure and the like.

As described above, in this embodiment, an attempt is made to minimize the amount by which the toner image on the recording medium spreads in the direction parallel to the surface of the recording medium as the toner image is squashed by the pressure applied by the heat roller type fixing apparatus 9 before the toner image is inlaid into the toner reception layer of the recording medium by the belt type fixing apparatus 110 to make the entire surface of the recording medium flat and smooth. That is, in order to achieve an image quality level which is as high as that of an image formed of silver salt photography, which is no less than 60 in glossiness level G and no more than 4.0 in graininess level R, the fixation conditions for the heat roller type fixing apparatus 9 are set so that after the heating and pressing of the recording medium and the toner image thereon by the heat roller type fixing apparatus 9, the glossiness level G and graininess level R of the image on the recording medium will be in the range of 5-40 ($5 \leqq G \leqq 40$) and 0.5-4.0 ($0.5 \leqq R \leqq 4.0$), respectively. With the employment of this setup, it is possible to obtain a highly glossy image of high quality, which matches in quality an image formed by silver salt photography, without rendering the image inferior in terms of graininess.

The above described heat roller type fixing apparatus was structured so that both the fixation roller as a rotational heating member, and the pressure roller as a rotational pressing member, were provided with a heat source. However, the structure of a heat roller type fixing apparatus does not need to be limited to the above-described one. All that is necessary is that at least the rotational heating member is provided with a heat source. Similarly, the above-described belt type fixing apparatus was structured so that both the heat roller as a rotational heating member, and the pressure roller as a rotational pressing member, are provided with a heat source. However, the structure of a belt type fixing apparatus does not need to be limited to the one described above. All that is necessary is that at least the rotational heating member has a heat source.

Also in the embodiment described above, the connection of the optional unit having the belt type fixing apparatus, which is the second image heating means employing an endless belt, to the image forming apparatus was optional. However, an image forming apparatus may be structured as follows. That is, an image forming apparatus having the image formation station may be structured so that not only the heat roller type fixing apparatus, but also, the belt type fixing apparatus, are the integral parts of the image forming apparatus.

Also in the embodiment described above, the image forming apparatus was an image forming apparatus of the rotary type, that is, an image forming apparatus in which multiple developing devices are supported by a rotary, as shown in FIG. 1, so that the developing devices can be selectively used by rotationally moving the rotary. However, the application of the present invention is not limited to the image forming apparatus in the preceding embodiment. For example, the present invention is also applicable to an image forming apparatus of the so-called tandem type, that is, an image forming apparatus in which multiple developing devices are juxtaposed as shown in FIG. 9.

Figure 9:
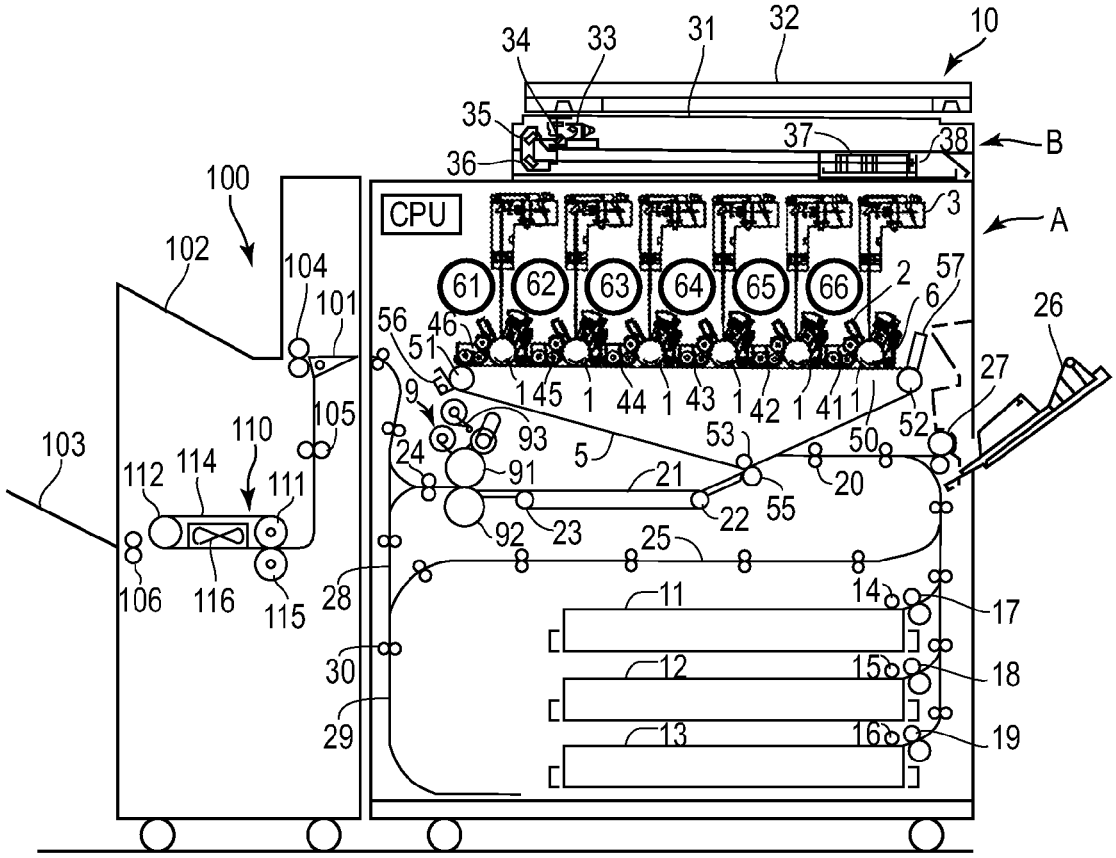
FIG. 9 is a schematic drawing of another example of an image forming apparatus, showing the general structure thereof.

Further, in the embodiment described above, the image forming apparatus is an image forming apparatus which has an intermediary transfer member, as shown in FIGS. 1 and 9, and in which toner images of required colors, one for one, are sequentially transferred in layers onto the intermediary transfer member, and then, the toner images borne on the intermediary transfer member are transferred all at once onto recording medium. However, the application of the present invention is not limited to the image forming apparatus in the preceding embodiment. For example, the present invention is also applicable to an image forming apparatus which has a recording medium bearing member placeable in contact with the photosensitive member, and in which toner images of required colors, one for one, are sequentially transferred in layers onto the recording medium borne on the recording medium bearing member, from the photosensitive member. Similarly, the present invention is also applicable to an image forming apparatus of the so-called tandem type, which uses a recording medium bearing member.

Also in the embodiment described above, the image forming apparatus was a printer. However, the application of the present invention does not need to be limited to a printer. For example, the present invention is also applicable to image forming apparatuses, such as a copying machine, a facsimile machine, or a multifunction image forming apparatus having the combination of the functions of the preceding machines, that is, an image forming apparatus other than a printer. By applying the present invention to the image heating apparatus which has an endless belt and employed by these image forming apparatuses, it is possible to obtain the same effects as those described above.

Further, the measurements, materials, and shapes of the structural components of the image forming apparatuses, and the positional relationship among the components, in the above described embodiment, are not intended to limit the scope of the present invention, unless specifically noted.

INDUSTRIAL APPLICABILITY

As described hereinabove, according to the present invention, it is possible to obtain a highly glossy image of high quality.

While the invention has been described with reference to the structures disclosed herein, it is not confined to the details set forth, and this application is intended to cover such modifications or changes as may come within the purposes of the improvements or the scope of the following claims.

The invention claimed is:

1. An image formation system comprising:

image forming means for forming different color toner images on a recording material having a toner reception layer;

first image heating means for heating and pressing a toner image on the recording material;

second image heating means for heating and pressing the toner image on the recording material having been heated and pressed by said first image heating means, wherein said first image heating means is operable so as to provide a granularity R of the toner image satisfying $0.5 \leqq R \leqq 4.0$ and a glossiness G of the toner image satisfying $5 \leqq G \leqq 40$, and said second image heating means is operable so as to provide a granularity R of the toner image whose value is not more than 4.0 and a glossiness G of the toner image whose value is not less than 60.

2. An apparatus according to claim 1, wherein said second image heating means is operable so as to provide a glossiness G of the toner image whose value is not more than 100.

3. An apparatus according to claim 1, wherein said second image heating means is operable so as to provide a glossiness G of the toner image whose value is not more than 90.

4. An apparatus according to claim 1, wherein the granularity and glossiness of the toner image produced by said first image heating means and said second image heating means are provided by setting an operating condition including at least one of a recording material feeding speed, a heating temperature, a pressure and a recording material separation temperature.

5. An apparatus according to claim 1, wherein said second image heating means includes an endless belt movable in contact with the toner image on the recording material, said endless belt having a glossiness whole value is not less than 60, and further includes cooling means for cooling the recording material which is moving in contact with said belt, after heating and pressing thereof.

6. An apparatus according to claim 1, wherein said image forming means is capable of forming the toner image using one or more sets of toners having the same hue and different lightness.

7. An image forming method comprising:

a first step of forming different color toner images on a recording material having a toner receiving layer;

a second step of heating and pressing a toner image formed on the recording material so as to provide a granularity R of the toner image satisfying $0.5 \leqq R \leqq 4.0$ and a glossiness G of the toner image satisfying $5 \leqq G \leqq 40$; and a third step of heating and pressing the toner image having been heated and pressed by said second step so as to provide a granularity R whose value is not more than 4.0 and a glossiness G whose value is not less than 60.

8. A method according to claim 7, wherein said third step provides a glossiness G of the toner image whose value is not more than 100.

9. A method according to claim 7, wherein said third step provides a glossiness G of the toner image whose value is not more than 90.

10. A method according to claim 7, wherein said third step cools the recording material after heating and pressing of the recording material.

11. A method according to claim 7, wherein said first step forms the toner image using one or more sets of toners having the same hue and different lightness.

12. A method comprising:

a first step of heating and pressing a toner image formed on a recording material having a toner receiving layer so as to provide a granularity R of the toner image satisfying $0.5 \leqq R \leqq 4.0$ and a glossiness G of the toner image satisfying $5 \leqq G \leqq 40$; and a second step of heating and pressing the toner image having been heated and pressed by said first step so as to provide a granularity R whose value is not more than 4.0 and a glossiness G whose value is not less than 60.

13. A method according to claim 12, wherein said second step provides a glossiness G of the toner image whose value is not more than 100.

14. A method according to claim 12, wherein said second step provides a glossiness G of the toner image whose value is not more than 90.

15. A method according to claim 12, wherein said second step cool the recording material after heating and pressing of the recording material.

* * * * *